US006075456A

United States Patent [19]

Park

[11] Patent Number: 6,075,456

[45] Date of Patent: Jun. 13, 2000

[54] METHOD OF AND APPARATUS FOR INDICATING LOCATION OF LOST OR MISPLACED PAGING RECEIVER AND ITS OWNER'S TELEPHONE NUMBER

[75] Inventor: Tae-Guen Park, Gumi, Rep. of Korea

[73] Assignee: Samsung Electronics Co., Ltd., Suwon, Rep. of Korea

[21] Appl. No.: 08/901,322

[22] Filed: Aug. 5, 1997

[30] Foreign Application Priority Data

Aug. 5, 1996 [KR] Rep. of Korea ..... 96/32649

[51] Int. Cl.[7] ..... G08B 5/22

[52] U.S. Cl. ..... 340/825.44; 455/38.2; 455/38.1

[58] Field of Search ..... 340/825.44, 825.69, 340/825.72, 825.49, 825.48, 825.59; 455/38.1, 38.2, 39

[56] References Cited

U.S. PATENT DOCUMENTS

| | | | |
|---|---|---|---|
| 4,639,726 | 1/1987 | Ichikawa et al. | 340/825.44 |
| 4,891,638 | 1/1990 | Davis | 340/825.44 |
| 4,918,438 | 4/1990 | Yamasaki . | |
| 4,943,803 | 7/1990 | Vrijkorte . | |
| 5,012,234 | 4/1991 | Dulaney et al. | 340/825.44 |
| 5,065,423 | 11/1991 | Gaskill | 379/57 |
| 5,095,307 | 3/1992 | Shimura et al. | 340/825.44 |
| 5,251,250 | 10/1993 | Obata et al. | 379/59 |
| 5,252,964 | 10/1993 | Tan et al. | 340/825.48 |
| 5,337,041 | 8/1994 | Friedman . | |
| 5,381,132 | 1/1995 | Yun | 340/825.44 |
| 5,381,138 | 1/1995 | Stair et al. | 340/825.44 |
| 5,428,663 | 6/1995 | Grimes et al. . | |
| 5,430,439 | 7/1995 | Bodet et al. | 340/825.44 |
| 5,463,368 | 10/1995 | Tsunoda et al. . | |
| 5,475,380 | 12/1995 | Shim . | |
| 5,499,020 | 3/1996 | Motohashi et al. . | |
| 5,546,077 | 8/1996 | Lipp et al. | 340/825.44 |
| 5,572,197 | 11/1996 | Matsumoto . | |
| 5,577,100 | 11/1996 | McGregor et al. | 379/58 |
| 5,740,532 | 4/1998 | Fernandez et al. | 455/404 |

FOREIGN PATENT DOCUMENTS 62-151923 6/1987 Japan .

*Primary Examiner*—Michael Horabik
*Assistant Examiner*—Anthony A. Asongwed
*Attorney, Agent, or Firm*—Robert E. Bushnell, Esq.

[57] ABSTRACT

A method of informing a finder of a paging receiver of its location and its owner's telephone number includes registering the owner's telephone number in a memory of the paging receiver; and when the paging receiver is misplaced or otherwise lost, calling the paging receiver so as to generate an audible speaker alarm and to provide a visual display of the owner's telephone number for informing the finder of the misplaced paging receiver of the location and the owner's telephone number.

14 Claims, 4 Drawing Sheets

| | |
|---|---|
| SPECIAL MESSAGE NO. | 99 |
| | 90 |
| | 89 |
| | • • • |
| | 98 |
| | • • • |
| LOST FUNCTION-ON AREA | AAh OR Ø |

*FIG. 2A*

| | |
|---|---|
| Password | |
| | 89 |
| | 98 |
| | 98 |
| | ⋮ |
| | BC |
| | |

FIG. 2B

| | |
|---|---|
| Owner Tel. No. | |
| | 02 |
| | 47 |
| | 57 |
| | 04 |
| | 3f |
| | |

FIG. 2C

METHOD OF AND APPARATUS FOR INDICATING LOCATION OF LOST OR MISPLACED PAGING RECEIVER AND ITS OWNER'S TELEPHONE NUMBER

This application makes reference to, incorporates the same herein, and claims all benefits accruing under 35 U.S.C. §119 from an application for *METHOD OF INFORMING ABOUT LOCATION OF MISSING PAGING RECEIVER AND ITS OWNER'S TELEPHONE NUMBER* earlier filed in the Korean Industrial Property Office on the Aug. 5, 1996, and there duly assigned Ser. No. 32649/1996, a copy of which application is annexed hereto.

BACKGROUND OF THE INVENTION

1. Technical Field

The present invention relates to pagers, and more particularly, relates to a method of indicating the location of a lost or misplaced paging receiver and its owner's telephone number by generating an alarm and concurrently displaying the telephone number of the original owner upon receipt of an input predetermined special code.

2. Related Art

Conventional paging systems, which come in various levels of sophistication, are personal message receiving devices which monitor a certain broadcast channel used by paging networks to alert or send information to specific subscriber units known as pagers. Exemplary configurations are disclosed, for example, in U.S. Pat. No. 5,381,132 for *Method Of Displaying Self-Address Data In A Pager Receiver* issued to Yun and U.S. Pat. No. 5,475,380 for *Time Alarm Method Of A Radio Paging Receiver* issued to Shim, both of which are assigned to the same assignee of the present invention. Each subscriber pager has an individual identification ID, i.e., cap-code stored in the pager. All of the pagers in an area monitor broadcast messages from a base station including a central transmitter. Each message is intended for a particular pager and has that pager's ID associated with the message. Thus, pagers in a particular service area all monitor a certain channel, i.e., frequency for broadcasts from the pager system transmitter looking for its ID. When the ID is present, that is when the ID is broadcast by the central transmitter, the message associated with the ID, which typically follows the ID, is acted upon by the pager.

Typically paging systems also have a variety of alarm such as disclosed, for example, in U.S. Pat. No. 4,918,438, for *Paging Receiver Having Audible And Vibrator Annunciating Means* issued to Yamasaki, U.S. Pat. No. 5,463,368 for *Method Of Setting An Inaudible Alert Mode In A Radio Pager* issued to Tsunoda et al., U.S. Pat. No. 5,499,020 for *Data Display Radio Pager* issued to Motohashi et al.

As the radio pager becomes increasing popular for business and personal communications, however, the chance of misplacement and lost is substantially greater. When a pager is missing, its finder who is not informed of the owner of the pager generally does not return the lost or misplaced pager to its original owner. This is usually because it is difficult to verify the identity of the original owner of the lost or misplaced pager. In some cases, a label can be attached to the pager so as to provide information of the pager's owner such as a telephone number or address, but the label can easily be pealed off the pager. However, most users do not attach such a label to their pagers because the label can spoil the appearance of the pager. Moreover, even if the lost or misplaced pager has a label bearing the owner's telephone number, the finder possibly will not be motivated to return the lost or misplaced pager to the original owner if the pager bears no information pertaining to the original owner. In addition to this, if a pager is lost or misplaced in the proximity of the original owner, the location of such a pager can be alerted to the original owner with an audible call tone.

SUMMARY OF THE INVENTION

Accordingly, it is therefore an object of the present invention to provide an improved pager and process of locating a lost or misplaced pager.

It is also an object to provide a method of informing a finder of a paging receiver of its location and its owner's telephone number.

It is another object to provide a method of registering the owner's telephone number in a memory of the paging receiver so that when the paging receiver is misplaced, the paging receiver can be called in order to generate an audible speaker alarm and to provide a visual display of the owner's telephone number for informing the finder of the misplaced paging receiver of the location and the owner's telephone number.

These and other objects of the present invention can be achieved by a pager including a receiver for receiving a call signal; a memory for storing an owner's telephone number, an input unit including a plurality of discrete keys; a controller for controlling operation of the pager and for informing a finder of the pager's location and the owner's telephone number; a display unit connected to said controller and energized to provide a visual display of the owner's telephone number, when the pager operates in a lost alert mode; a speaker connected to said controller and energized to generate an audible tone for alerting the finder of the pager's location, when the pager operates in said lost alert mode. The controller informs the finder of the pager's location and the owner's telephone number by a series of steps of determining whether a special message number and a code for * key are contained in the call signal; when the special message number and a code for * key are not contained in the call signal, determining whether the special message number and another code other than * and # keys are contained in the call signal; when the special message number and the code other than * and # keys are not contained in the call signal, determining whether the special message number and a code for # key are contained in the call signal; and when the special message number and a code for # key are contained in the call signal, setting the pager in the lost alert mode to activate generation of an audible alarm and visual display of the owner's telephone number previously registered in the memory for informing the finder of the pager's location and the owner's telephone number.

After the lost pager is returned to the owner, the owner must call his pager again and deactivate the lost alert mode for generating an audible speaker alarm and visual display of his telephone number. This is done when the controller deactivates generation of the audible alarm and interrupts a visual display of the owner's telephone number previously registered in the memory, when the special message number and a code for * key are contained in the call signal.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIGS. 2A–2C are memory map constructions according to the preferred embodiment of the present invention.

DETAILED DESCRIPTION OF THE PREFERRED EMBODIMENT

Figure 1:
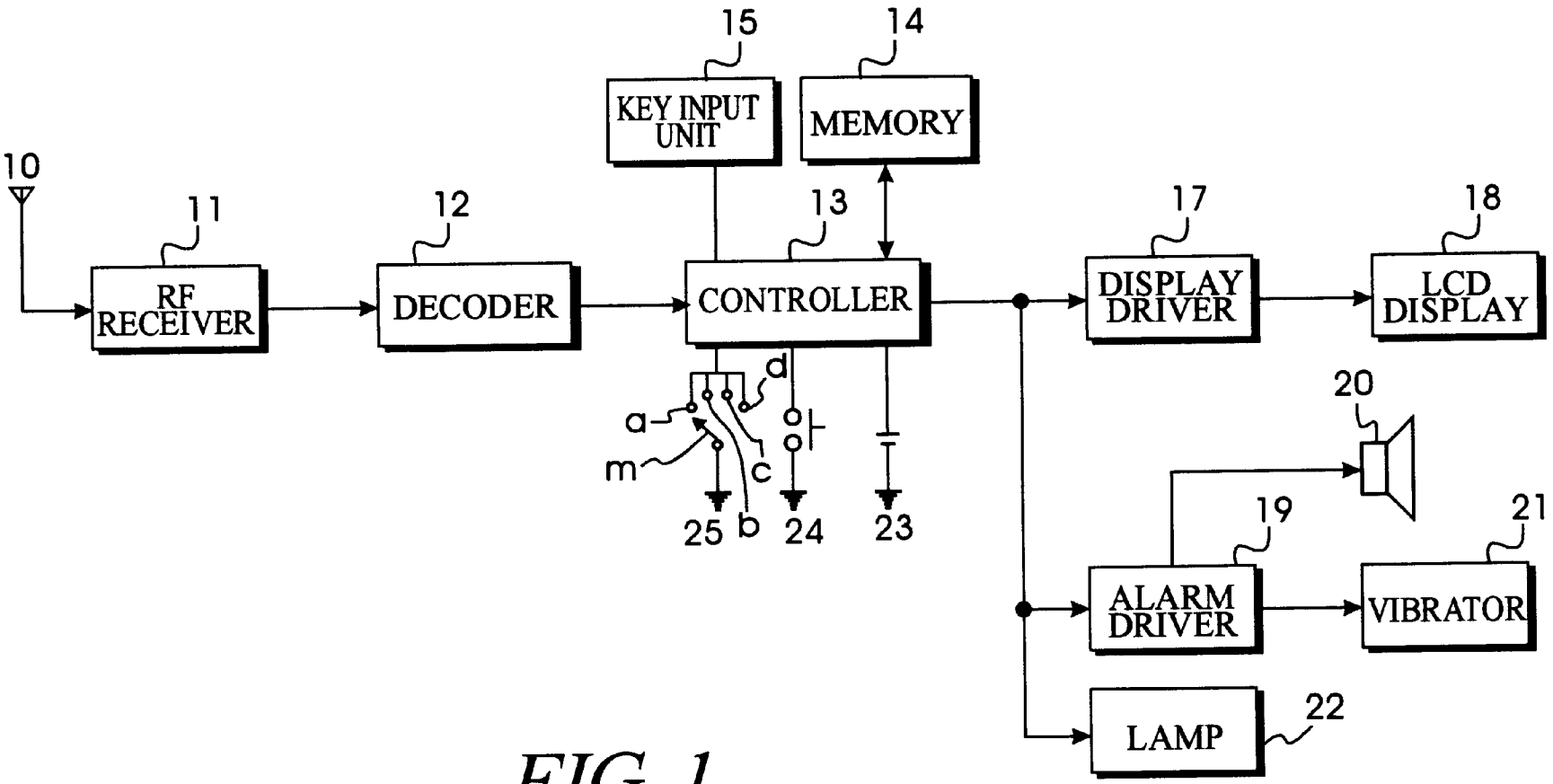
FIG. 1 illustrates a radio pager constructed according to the principles of the present invention.

Referring now to the drawings and particularly to FIG. 1, which illustrates a radio pager (paging receiver) constructed according to the principles of the present invention. The radio pager is for selectively receiving a plurality of call signals which are specific to the pager. Each of the call signals includes a call number and a message following the call number and is transmitted as a radio signal from a paging terminal (not shown). The call number represents a number assigned to the radio pager to which the message should be directed. As shown in FIG. 1, the radio pager has an antenna 10, a radio-frequency (RF) receiver 11, a decoder 12, a controller 13 for controlling an operation mode setting of the pager and for enabling the pager to operate in the operation mode, a display driver 17 and its liquid crystal display LCD 18, a memory 14 including a read-only-memory (ROM) for storing a program which controls the overall operations of the pager, a random-access-memory (RAM) for defining a work space needed for pager operations and a memory section which can employ an electrically erasable programmable read-only-memory (EEPROM) for storing information such as the original owner's address and telephone number and other information required for the functions of the pager, an alarm driver 19 for driving operation of a speaker 20 and a vibrator 21, a lamp 22 and battery 23. A key input unit 15 includes alpha-numeric keys, and an operation mode selection key. The alpha-numeric keys includes a read key for confirming the messages received from RF receiver 11. The mode selection key allows the user to set the pager for automatic operation in one of a silent mode, an audio mode, a vibration mode and an audio and vibration mode. Optionally, the radio pager also includes a reset switch 24 and a mode setting switch 25 both of which are connected to the controller 13 for allowing the user to manually set the pager in one of a silent mode, an audio mode, a vibration mode and an audio and vibration mode whenever the user desires. The mode setting switch 25 is switchable to a plurality of positions for selecting the silent mode, the audio mode, the vibration mode and the audio and vibration mode one at a time. In particular, the mode setting switch 25 comprises first, second, third and fourth fixed contact points a, b, c, d each representing the corresponding silent mode, audio mode, vibration mode and audio and vibration mode, and a movable contact member m which is selectively connected to a selected one of the first, second, third and fourth fixed contact points a, b, c, d.

In operation, a call signal coming in through an antenna 10 is amplified and demodulated by the RF receiver 11. The RF receiver 11 is typically a circuit arrangement comprised of a high frequency amplifier, a frequency converter, an intermediate frequency (IF) amplifier and a discriminator. Although not shown in FIG. 1, the RF receiver 11 is usually periodically energized by a plurality of preamble search pulses which are applied from the controller 13 for battery saving purposes. The output of the RF receiver 11 is then applied, after being wave-shaped, to a decoder 12. The decoder 12 searches for a preamble during a preamble search mode (an idle mode) and a synchronization codeword preceded thereby during an address search mode (a batch mode). If the codeword is detected, the decoder 12 searches for an identification address code by comparing the same with a user's unique code contained in the decoder 12.

When the identification address code contained in the call signal received through the antenna 10 coincides with the user's unique code, the decoder 12 activates the controller 13 and then applies the message data included in the call signal received through the antenna 10 to the controller 13. When the controller 13 receives the message data, a central processing unit (CPU) which is a one chip micro-processor in the controller 13 activates one of, or a combination of a speaker (buzzer) 20 through an alarm driver 19, a vibrator 21 and a lamp 22 through a lamp driver (not shown) in dependence upon an operation mode, i.e., whether the pager operates in one of a silent mode, an audio mode, a vibration mode, and an audio and vibration mode.

According to the principles of the present invention, a speaker 20 is energized to generate an audible tone for alerting the user of an incoming call in the audio mode as well as alerting all people in the proximity of the lost or otherwise misplaced paging receiver of the location of the lost or misplaced paging receiver, when the original owner calls his missing paging receiver with a special message number and a predetermined code. A vibrator 21 is energized to generate vibration for alerting the user in a vibration mode. Both a speaker 20 and a vibrator 21 are simultaneously energized for alerting the user in an audio and vibration mode. A lamp 22 is energized to intermittently generate light for alerting the user in a silent mode. Separately, the lamp 22 can be energized along with the speaker 20 in the audio mode and the vibrator 21 in the vibration mode to visually notify the user of an incoming call. Preferably, the lamp 22 is constructed by a light emission diode (LED) connected to the controller 13 through a LED driver for intermittently emitting visible light for alerting the user when the pager operates in the silent mode. Further, the message directed to the user is displayed on a LCD display 18 through a display driver 17 regardless of whether the pager operates in any of the silent mode, the audio mode, the vibration mode and the audio and vibration mode. In addition, a telephone number of the original owner of the paging receiver that has previously been registered by the original owner is continuously displayed on the LCD display 18, when the original owner calls his missing paging receiver with a special message number and a predetermined code so that the finder of the lost or otherwise misplaced paging receiver can contact the original owner to return the missing paging receiver.

Figure 3:
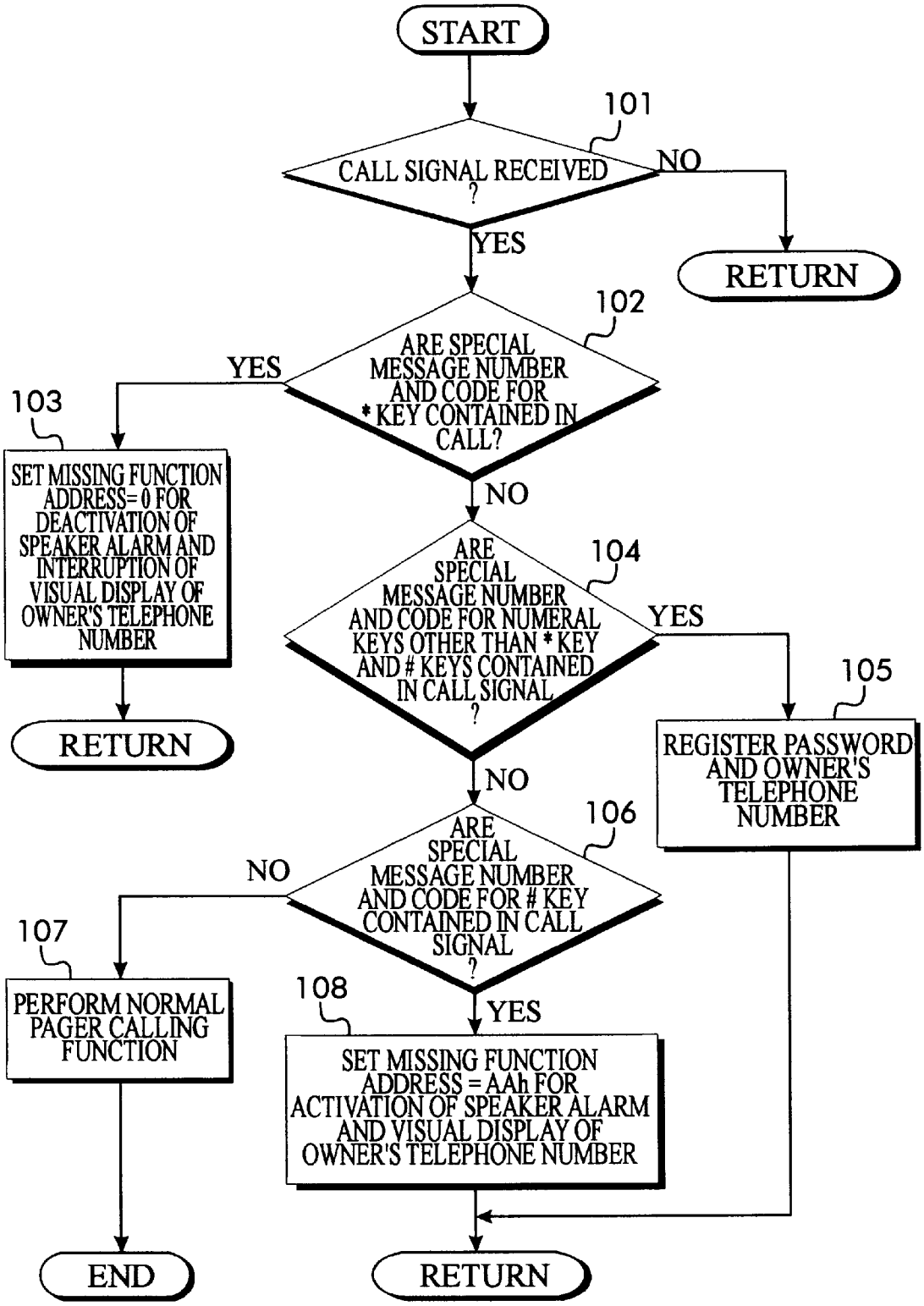
FIG. 3 is a flow chart of a control process of generating an alarm and displaying a telephone number of the original owner of a lost or misplaced pager according to the principles of the present invention.

FIGS. 2A to 2C illustrate memory map constructions according to the principles of the present invention. FIG. 2A shows a storage area of the memory 14 for storing a special message number, FIG. 2B shows a storage area of the memory 14 for storing a password which is a special message command, and FIG. 2C shows a storage area of the memory 14 for storing the owner's log telephone number, respectively. FIG. 3 is a control flow diagram to generate an alarm and display the owner's telephone number in accordance with the present invention.

The operation of the pager constructed according to the principles of the present invention can be described in detail with reference to FIG. 1, FIG. 2 and FIG. 3, hereinbelow.

First, in order to attain the objectives of the invention, when the paging receiver is initially purchased, the seller must register the owner's telephone number and a special message command (password). Then, the original owner can call his own paging receiver and register his password and telephone number therein for subsequently informing the location of the lost or misplaced paging receiver and providing a visual display of the owner's telephone number so that the finder of the lost or otherwise misplaced paging receiver can contact the original owner to return the paging receiver.

Referring to FIG. 3, when the owner calls his paging receiver for any purpose including to register his password (i.e., a special message command) and telephone number so that the owner can be contacted by a finder in a case when the paging receiver is lost or misplaced, a call signal is received at the RF receiver 11 of paging receiver. It is noted here that the password is needed for registration so that only the original owner can activate and deactivate operation of speaker alarm which overrides all normal modes of operation of the paging receiver in order to alert people in the proximity of the lost or misplaced paging receiver of the location of the lost or misplaced paging receiver. Simultaneously to the activation or deactivation of speaker alarm, the original owner can also set and interrupt a visual display of the owner's telephone number on the LCD display 18.

When the call signal is received at the RF receiver 11 at step 101, the controller 13 checks the arrival of the call signal and examines whether a special message number as shown in FIG. 2A and a code for * key are contained in the call signal at step 102. The special message number indicates a pager identifying function other than a pager calling function, the pager identifying function including activation or deactivation of a lost alert mode and a registration mode for registering a pager owner's telephone number, for example. If the special message number as shown in FIG. 2A and a code for * key are not contained in the call signal at step 102, the CPU of controller 13 next determines whether the special message number and a code for numeral keys other than * and # keys are contained in the call signal at step 104. If the special message number and the code for numeral keys other than * and # keys are contained in the call signal, the controller 13 proceeds to step 105 for a pager identifying function of allowing registration of the original owner's password as shown in FIG. 2B and telephone number as shown in FIG. 2C. The password is a special message command needed to prevent others including the finder of a lost paging receiver from deleting the telephone number of the original owner that is displayed on the LCD display 18 along with the speaker alarm when the paging receiver is lost or misplaced and the original owner calls for his paging receiver. Since the telephone number of the original owner can not be deleted, the finder will be more likely to return the lost or misplaced paging receiver when it is found.

The controller 13 registers a numerical set consisting of a predetermined number of numerals representing a password in memory 14 in a storage area following the special message number stored in memory 14. Then, the numerics representing the owner's telephone number as shown in FIG. 2C following the password are registered in memory 14. As indicated earlier, the password is a special message command which is required to prevent others from deleting the telephone number of the owner.

When the owner calls his lost otherwise missing paging receiver, the CPU of controller 13 examines whether a special message number as shown in FIG. 2A and a code for # key are contained in the call signal at step 106. With the special message number and the code for # key entered, the controller 13 sets a lost function-on area of memory 14 as AAh, in step 108. That is, the controller 13 activates a pager identifying function of a lost alert mode of the paging receiver in order to drive the alarm driver 19 so as to generate an audible speaker alarm instead of vibration even if the paging receiver was originally set in a vibration mode and displays the owner's telephone number or even the owner's address on the LCD display 18. For example, a message such as "OWNER Tel: 20-475-7043" or "FINDER PLEASE CALL: 20-475-7043" can be displayed on LCD display 18. The LCD display 18 displays this message with continuous generation of an audible speaker alarm, so that the finder is motivated to return the paging receiver to the original owner.

After the paging receiver is returned to the original owner, however, the owner must call his paging receiver and cancel or deactivate the lost alert mode for generating an audible speaker alarm and visual display of his telephone number. This pager identifying function of deactivating the lost alert mode is done when the controller 13 confirms that the call signal received at the RF receiver 11 contains the special message number and the code for * key at step 102. Upon confirmation, the CPU of controller 13 sets the lost function-on area of the memory 14 as 0 so as to cancel the operation for generating an alarm and displaying the owner's telephone number at step 103. In the meantime, the CPU of controller 13 respectively drives the alarm driver 19 and the display driver 17 so as to interrupt the continuous speaker alarm generated through the speaker and the message for the owner's telephone number displayed on the LCD display 18. If the call signal contains a usual telephone number instead of the special message number and the code for # key, in step 106, the controller 13 proceeds to step 107 for performing a normal pager calling function, rather than a pager identifying function, that is to alert a person using the paging receiver of an incoming call and messages.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof Therefore, it is intended that the present invention not be limited to the particular embodiment disclosed as the best mode contemplated for carrying out the present invention, but that the present invention includes all embodiments falling within the scope of the appended claims.

What is claimed is:

1. A method of identifying a pager, comprising the steps of:

registering a telephone number for an owner of the pager in a memory of the pager;

providing a call signal to the pager, the call signal containing a special message number and a predetermined code, the special message number for selectively indicating a pager identifying function other than a pager calling function, and the predetermined code corresponding to a pager identifying function of a lost alert mode; and enabling generation by the pager of an audible speaker alarm and a visual display of the telephone number of the owner of the pager to inform a finder of the pager of the pager owner's telephone number when a call signal containing the special message number and the predetermined code is received by the pager, wherein said audible speaker alarm is generated in the lost alert mode even when the pager is set in a vibration mode.

2. The method as claimed in claim 1, wherein the pager owner's telephone number is registered in said memory when the special message number and a password are entered with the pager called.

3. A method of identifying a pager, comprising the steps of:

receiving a call signal via an antenna;

determining whether a special message number and a predetermined code are contained in the call signal, the special message number for selectively indicating a pager identifying function, and said predetermined code corresponding to a pager identifying function;

when the special message number and a first predetermined code are not contained in the call signal, determining whether the special message number and another code different from said first predetermined code and a second predetermined code are contained in the call signal;

when the special message number and the another code different from said first predetermined code and said second predetermined code are not contained in the call signal, determining whether the special message number and said second predetermined code are contained in the call signal; and when the special message number and said second predetermined code are contained in the call signal, setting the pager in a lost alert mode to activate generation of an audible alarm and visual display of a telephone number for an owner of the pager previously registered in a memory of the pager for informing a finder of the pager of the pager owner's telephone number.

4. The method as claimed in claim 3, further comprising the step of performing a pager calling function when the special message number, said first predetermined code, said second predetermined code and said another code are each not contained in the call signal.

5. The method as claimed in claim 3, further comprising the step of registering a password and the pager owner's telephone number in said memory when the special message number and the another code different from said first predetermined code and said second predetermined code are contained in the call signal.

6. The method as claimed in claim 3, further comprising the step of deactivating said lost alert mode to deactivate generation of said audible alarm and to interrupt a visual display of the pager owner's telephone number previously registered in said memory when the special message number and said first predetermined code are contained in the call signal.

7. The method as claimed in claim 3, wherein said audible alarm is generated in the lost alert mode even when the pager is set in a vibration mode.

8. A pager, comprising:

receiver means for receiving a call signal;

a memory for storing a telephone number for an owner of the pager;

an input unit including a plurality of discrete keys that are independently operable by manual depression by a user;

a controller for controlling operation of the pager and for informing a finder of the pager of the pager owner's telephone number;

a display unit connected to said controller and energized to provide a visual display of the pager owner's telephone number when the pager operates in a lost alert mode;

a speaker connected to said controller and energized to generate an audible tone for alerting the finder of the pager when the pager operates in said lost alert mode;

said controller informing the finder of the pager of the pager owner's telephone number by:

determining whether a special message number and a predetermined code are contained in the call signal, the special message number for selectively indicating a pager identifying function and said predetermined code corresponding to a pager identifying function;

when the special message number and a first predetermined code are not contained in the call signal, determining whether the special message number and another code different from said first predetermined code and a second predetermined code are contained in the call signal;

when the special message number and the another code different from said first predetermined code and said second predetermined code are not contained in the call signal, determining whether the special message number and said second predetermined code are contained in the call signal; and when the special message number and said second predetermined code are contained in the call signal, setting the pager in said lost alert mode to activate generation of an audible alarm and visual display of the pager owner's telephone number previously registered in said memory for informing the finder of the pager of the pager owner's telephone number.

9. The pager as claimed in claim 8, wherein said controller performs a pager calling function when the special message number, said first predetermined code, said second predetermined code and said another code are each not contained in the call signal.

10. The pager as claimed in claim 8, wherein said controller registers a password and the pager owner's telephone number in said memory when the special message number and the another code different from said first predetermined code and said second predetermined code are contained in the call signal.

11. The pager as claimed in claim 9, wherein said controller registers a password and the pager owner's telephone number in said memory when the special message number and the another code different from said first predetermined code and said second predetermined code are contained in the call signal.

12. The pager as claimed in claim 8, wherein said controller deactivates said lost alert mode to deactivate generation of said audible alarm and to interrupt a visual display of the pager owner's telephone number previously registered in said memory when the special message number and said first predetermined code are contained in the call signal.

13. The pager as claimed in claim 11, wherein said controller deactivates said lost alert mode to deactivate generation of said audible alarm and to interrupt a visual display of the pager owner's telephone number previously registered in said memory when the special message number and said first predetermined code are contained in the call signal.

14. The pager as claimed in claim 8, wherein said audible alarm is generated in said lost alert mode even when the pager is set in a vibration mode.

* * * * *